US006358337B1

(12) United States Patent
Esteban Sanz et al.

(10) Patent No.: US 6,358,337 B1
(45) Date of Patent: Mar. 19, 2002

(54) PROCESS FOR THE ANNEALING OF DRAWN CARBON STEEL ROLLS AND COILS OF CARBON STEEL SHEET

(75) Inventors: Luis Vidal Esteban Sanz, Guadalajara; Jorge Aixa Barcelo, Valencia, both of (ES)

(73) Assignee: L'Air Liquide, Societe Anonyme pour l'Etude et l'Exploitation des Procedes Georges Claude, Paris (FR)

( * ) Notice: Subject to any disclaimer, the term of this patent is extended or adjusted under 35 U.S.C. 154(b) by 0 days.

(21) Appl. No.: 09/554,085

(22) PCT Filed: Nov. 11, 1998

(86) PCT No.: PCT/EP98/07327

§ 371 Date: May 12, 2000

§ 102(e) Date: May 12, 2000

(87) PCT Pub. No.: WO99/25882

PCT Pub. Date: May 27, 1999

(30) Foreign Application Priority Data

Nov. 14, 1997 (ES) ..... P9702393

(51) Int. Cl.[7] ..... C21D 1/26; C21D 9/61; C21D 9/52

(52) U.S. Cl. ..... 148/508; 148/634

(58) Field of Search ..... 148/508, 634

(56) References Cited

U.S. PATENT DOCUMENTS 5,569,339 A * 10/1996 Scheuermann ..... 148/634

FOREIGN PATENT DOCUMENTS

| | | |
|---|---|---|
| DE | 44 28 614 A | 2/1996 |
| EP | 0 156 147 | 10/1985 |
| EP | 0 405 092 A | 1/1991 |
| FR | 1.202.845 | 1/1960 |
| GB | 969487 | 9/1964 |

* cited by examiner

*Primary Examiner*—Scott Kastler
(74) *Attorney, Agent, or Firm*—Burns, Doane, Swecker & Mathis, L.L.P.

(57) ABSTRACT

Improved process for the annealing of drawn carbon steel rolls and coils of rolled carbon steel sheet. This process is characterized in that in the stage of roll heating the heating is stopped before reaching the temperature at which the reaction between carbon and $H_2O$ in the vapour phase starts. The core of the steel roll is then allowed to heat up progressively until its temperature reaches that of the outer part of the roll. With progressive removal of moisture from the core of the steel roll, heating is applied progressively until a minimum moisture level guaranteeing a sufficiently low partial pressure to avoid the reaction between the carbon in the steel and water vapour is reached. Heating is then continued up to the desired annealing temperature.

10 Claims, 2 Drawing Sheets

PROCESS FOR THE ANNEALING OF DRAWN CARBON STEEL ROLLS AND COILS OF CARBON STEEL SHEET

This application is a 371 of PCT/EP98/07327 filed Nov. 11, 1998.

BACKGROUND OF THE INVENTION (i) Field of the Invention

This invention relates to an improved process for the annealing of drawn carbon steel rolls and coils of carbon steel sheet.

(ii) Description of Related Art

One of the sectors of the steel processing industry is that of drawing.

Drawing steel comprises passing the steel through a die, which has a specific cross-section which may be circular, square, hexagonal, etc., in order to obtain a piece of great length and constant cross-section which is identical to the cross-section of the die. This piece, which is obtained by cold forming, is obtained by applying a specific continuous pulling force to the end.

A lubricant, which is normally sodium stearate or calcium stearate, is applied to the material in order to ease the passage of the steel being shaped through the die, immediately before it passes through the die.

This lubricant adheres firmly to the entire surface of the part and its entire length.

As the pieces obtained by drawing are very long, on leaving the drawing machine they are made into rolls of a specific weight, which assists subsequent handling.

Pieces obtained by cold drawing undergo changes in their crystalline structure and mechanical properties as a result of this process and cannot always be used in that state in industry.

Most frequently these pieces, as rolls, are subjected to annealing heat treatment, recrystallization heating, to restore the structure of drawn pieces and adjust their mechanical properties for subsequent processes in the industry.

When these pieces have been hot drawn—wire drawing—they are also subjected to globulizing heat treatment.

The annealing treatment consists of progressively heating the drawn steel rolls from ambient temperature to a specific temperature above 700° C., and once the mass of steel in the rolls reaches the specified temperature they are allowed to cool slowly to ambient temperature.

If the necessary precautions are not taken during the process of annealing the drawn steel rolls, the steel can lose some of the carbon which it contains, and if this occurs and the loss of carbon is greater than that accepted in the specifications, the quality of the steel suffers and it cannot be used for the task for which it was intended.

This loss of carbon can only be caused by:

- reaction between the carbon in the steel and oxygen,
- reaction between the carbon in the steel and carbon dioxide,
- reaction between the carbon in the steel and water, in the vapour state.

Of the three reactions mentioned, the one having the most marked effects and the one which is the most difficult to avoid is the last one shown, that is the reaction between the carbon in the steel and water vapour.

Necessary precautions are taken in the industry to avoid these risks of carbon loss, the solution most widely used being the use of inert atmospheres, in which the component is nitrogen, or slightly reactive atmospheres in which the basic component is nitrogen with very small concentrations of a hydrocarbon, normally natural gas or propane.

In this way, and with normal annealing cycles—continuous heating up to the specified annealing temperature—reactions between the carbon in the steel and oxygen and carbon dioxide are successfully prevented, but not the reaction between the carbon in the steel and water vapour, so there is a loss of carbon from the steel after treatment, and this despite a relatively high consumption of atmosphere in relation to the quantity of steel annealed.

It is relatively easy to eliminate the species which oxidize the carbon in the steel, oxygen ($O_2$) and carbon dioxide ($CO_2$), and this can be done without difficulty before the outer coils of the steel rolls reach the temperature of 680° C., which is the temperature at which the reaction between the carbon in the steel and the previously mentioned species which oxidize it, $O_2$, $CO_2$ and $H_2O$, begins.

This is not the case however for water vapour ($H_2O$), which is also another oxidizing agent for the carbon in the steel, and which furthermore has more marked oxidizing effects.

In the normal cycles for annealing drawn steel rolls, when heating is continuous up to the annealing temperature—always above 680° C.—the following take place:

- When the outer turns of the drawn steel rolls reach a temperature of 680° C. the centre or core of the rolls is still at a lower temperature. This temperature gradient can be 25 to 50° C. depending upon the size of the rolls.
- This temperature gradient—with colder cores in the rolls—is sufficient to ensure that not all the moisture in the centres or cores of the steel rolls has been eliminated.
- This moisture leaves the core of the steel rolls, and coming into contact with the outer turns of the rolls at a temperature of 680° C. or more reacts with the carbon and gives rise to a loss of carbon or decarburization of the material.

SUMMARY AND OBJECTS OF THE INVENTION

The purpose of this invention is to improve the process described above, for which purpose it is proposed that the following four operations be performed:

- modification of the annealing cycle during the heating stage,
- continuous analysis of the quantity of $H_2O$ present in the atmosphere (within the furnace and in direct contact with the drawn steel rolls),
- holding for a sufficient time for the removal of water to reach a level such that the partial pressure of the said water is sufficiently low for there to be no risk that this water will react with the carbon in the steel, and
- strongly reducing the flow of atmosphere when the analysed $H_2O$ level presents no risk of reaction with the carbon in the steel.

By proceeding in this way drawn steel rolls can be annealed without any loss of carbon and with a smaller total consumption of atmosphere than in the normal annealing processes known hitherto.

Thus one object of this invention is a process for annealing drawn carbon steel rolls in which the steel being shaped, to which a lubricant has previously been applied, is caused to pass through a die of specified cross-section, producing a roll by cold forming which is subsequently subjected to annealing heat treatment by progressively heating the drawn roll up to a specified temperature, after which the entire roll is allowed to cool slowly to ambient temperature, characterized in that in the heating stage heating of the steel roll is stopped before the temperature at which the reaction between the carbon in the steel and $H_2O$ in the vapour phase begins, avoiding the said reaction between the carbon in the steel and the water vapour, after which the temperature of the core of the steel roll is allowed to become the same as that in the outer part of the roll, with the progressive removal of moisture from the core of the steel roll, until a minimum moisture level is reached which guarantees a sufficiently low partial pressure to avoid the reaction between the carbon in the steel and the water vapour, after which heating is continued to the desired annealing temperature, thus obtaining rolls of steel which are not decarburized.

According to the invention, heating of the drawn roll is stopped at a temperature of between 620° C. and 670° C.

Likewise, according to this invention, the annealing temperature is 680° C. or higher.

In accordance with the invention, during the annealing process the moisture content in the form of water vapour present in the atmosphere within the annealing furnace in direct contact with the rolls of drawn steel is continually analysed, as a result of which if the $H_2O$ level is sufficiently low heating is continued to the specified annealing temperature and the incoming flow of atmosphere into the annealing furnace is reduced, and if the level of $H_2O$ is higher than the value which is considered to be without risk of reaction with the carbon in the steel, the incoming flow of atmosphere into the annealing furnace is increased.

The process described above can likewise be applied to the annealing of carbon steel sheet coils when it is desired to avoid the loss of carbon from the sheet, and likewise this process must also be regarded as an object of this invention.

The process according to this invention will be described in greater detail below with the help of the accompanying drawings. It should however be understood that these drawings show a particularly preferred embodiment of the process according to the invention which should not be regarded as limiting it in any way.

DETAILED DESCRIPTION OF PREFERRED EMBODIMENTS

Figure 1A:
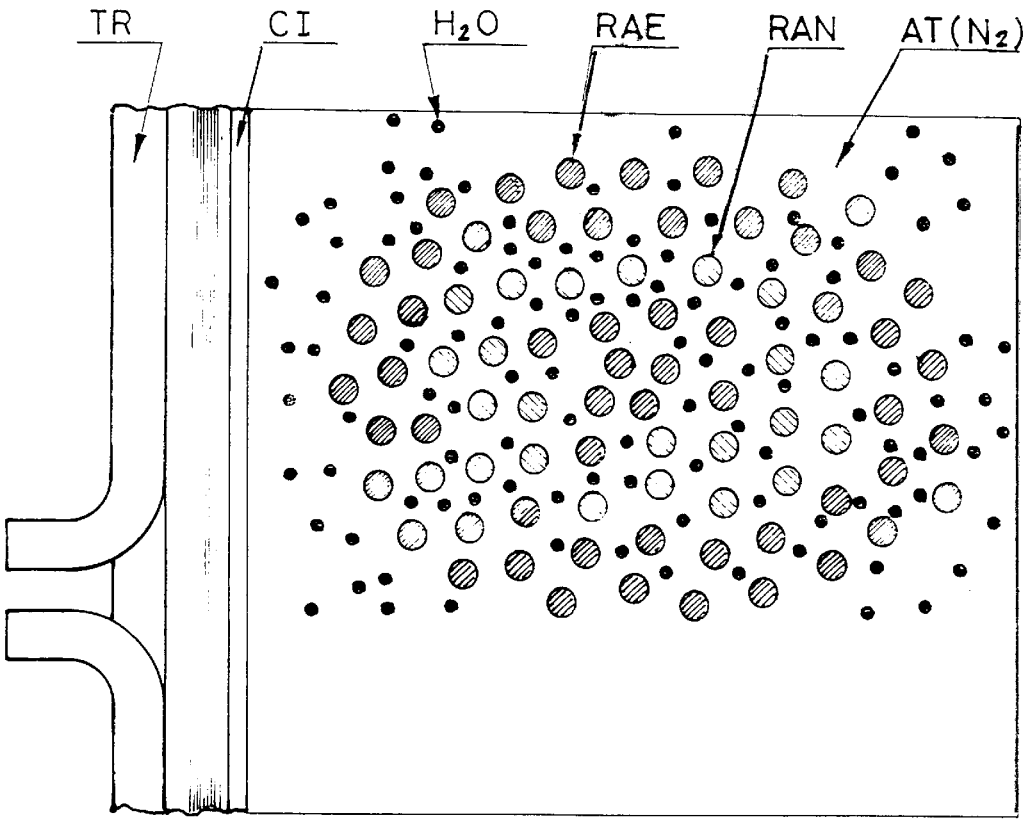
FIG. 1A: a detail in transverse cross-section of the furnace, the inner space and the roll of steel during the annealing process in an annealing furnace according to the known state of the art.

With reference to FIG. 1A in the drawings, this shows a transverse cross-sectional view of an annealing furnace in which a drawn carbon steel roll is being annealed, an annealing which in reality comprises a heat treatment process with a view to softening the steel without altering its surface chemical composition. In this figure (TR) indicates the tube radiating energy and (CI) constitutes the internal space of the annealing furnace. As may be seen, in the heart of the steel roll the turns (RAN) are at a temperature of 650° C. and furthermore a great quantity of $H_2O$ is present in an atmosphere (AT) of $N_2$, but despite this the turns (RAN) do not become decarburized because their temperature is below 680° C. However, at the same time the outer turns (RAE) of the steel roll are at a temperature of 700° C. and, as a large quantity of $H_2O$ leaving the core of the steel roll is present in the $N_2$ atmosphere (AT), this $H_2O$ reacts with the carbon in the outer turns of the steel roll because these turns are at a higher temperature than the temperature at which the reaction starts (680° C.) and the steel becomes decarburized.

Figure 1B:
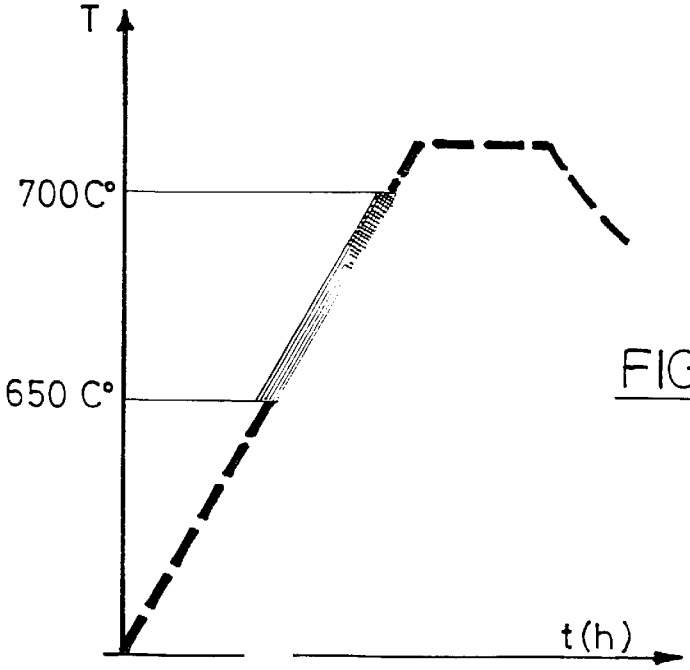
FIG. 1B: a graph of temperature as a function of time showing the annealing cycle in a process according to the known state of the art.

FIG. 1B shows a graph of temperature as a function of time in the annealing cycle for drawn carbon steel rolls, in which it will be seen that in this case heating of the steel rolls takes place without interruption from ambient temperature up to the annealing temperature, which corroborates the fact that at least some partial decarburization of the rolls can take place in these rolls.

Figure 2A:
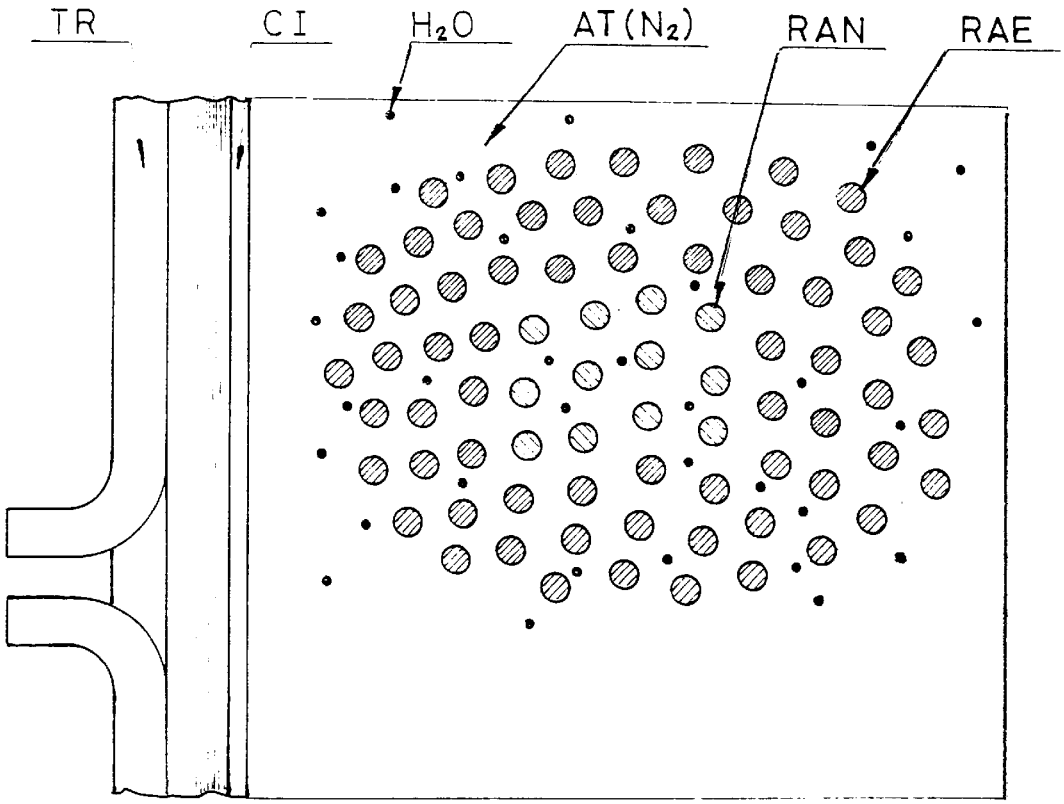
FIG. 2A: a detail of the furnace, internal space and the steel roll in transverse cross-section during the process of annealing in an annealing furnace according to the invention.
Figure 2B:
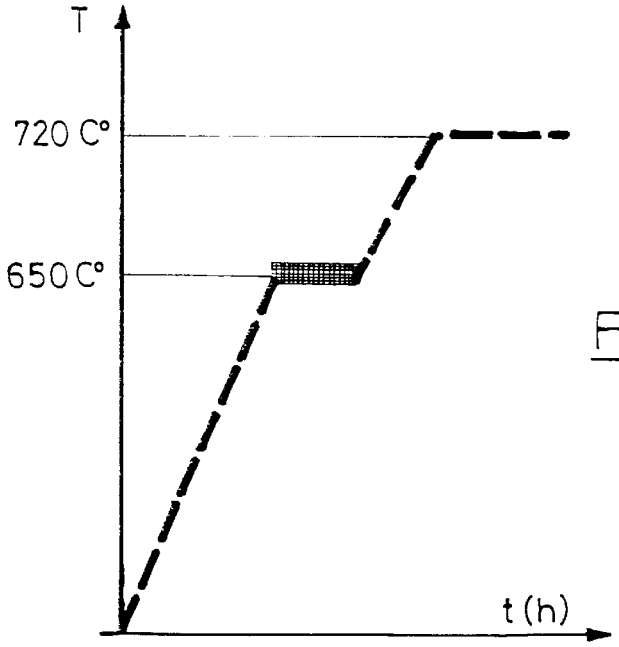
FIG. 2B: a graph of temperature as a function of time showing the annealing cycle in a process according to the invention.

With reference to FIG. 2A, this shows the same cross-section as in FIG. 1A, but in this case all the turns in the roll of steel are at the same temperature of 650° C., both the turns (RAN) in the heart of the steel roll and the turns (RAE) on the outside of the steel roll, and in addition to this there is a smaller quantity of $H_2O$ present in the atmosphere (AT) of the furnace than in the case of the known annealing process in the prior art. This smaller quantity of water in the atmosphere is due to the fact that heating of the steel rolls was stopped at a temperature of 650° C. and held at this temperature for a sufficient time for the $H_2O$ to leave the core of the steel rolls and for the $H_2O$ to leave the atmosphere of the furnace for the exterior at the same time. This is what is shown in the graph in FIG. 2B, in which it can be seen that heating is stopped during the heating stage, for example at 650° C., before reaching the temperature at which the reaction between the carbon in the steel and $H_2O$ begins. By working in this way the outer turns in the rolls will not exceed this temperature, with the result that there will be no reaction between the carbon in the steel and water.

On the other hand, in the core of the rolls, which is colder, heating will take place progressively until the temperature becomes equal to that in the outer turns. At the same time moisture progressively leaves the interior, and is evacuated from the annealing furnace by dilution and purging ($H_2O$-free atmosphere is continually entering the furnace and the same quantity of atmosphere+$H_2O$ is leaving it).

This is only achieved over a period of time, and this will be the time required to achieve the same temperature (somewhere between 620 and 670° C.) throughout the mass of the rolls, and the time required to remove all the moisture from the interior of the furnace or the moisture content necessary—as shown by analysis—to achieve a minimum level which ensures a partial pressure that is sufficiently low not to give rise to the reaction with the carbon in the steel when heating of the entire mass is subsequently continued and a temperature of 680° C. or higher is reached.

Results obtained with a drawn carbon steel annealed in accordance with a known process according to the prior art and those obtained with the process according to this invention indicate that a decarburized zone may be present in the drawn carbon steel roll after the annealing process of the prior art, a zone which is not observed in the roll of steel which was annealed in accordance with the process according to the invention.

The process of annealing to which this invention relates makes use of equipment for continuously analysing moisture content and when this measures a level of $H_2O$ which is sufficiently low not to bring about the loss of carbon from the steel it emits a signal which makes it possible to:

continue heating up to the specified annealing temperature, reduce the incoming flow of atmosphere to the furnace.

If during the rest of the annealing cycle up to the specified temperature, during holding at this annealing temperature and during cooling down to 680° C., the analyser detects and measures an $H_2O$ value which is greater than the value considered to be without risk of reaction with the carbon in the steel, it sends a signal to immediately increase the flow of atmosphere into the furnace in order to immediately remove the anomalous increase in $H_2O$ by dilution and purging, and this is maintained until suitable conditions of zero risk of decarburization of the steel and low atmosphere consumption are re-established.

The annealing process described above is likewise applicable to the annealing of carbon sheet steel coils when it is desired to avoid the loss of carbon from the sheet.

It should be understood that what has gone before is a merely illustrative description of the subject matter of this invention and that a number of modifications may be made therein by those skilled in the art which should be regarded as falling within the scope of the invention which is only limited by the appended claims.

What is claimed is:

1. A process for annealing drawn carbon steel rolls comprising the steps of:

(i) passing steel being shaped, to which a lubricant has previously been applied, through a die of specified cross-section, producing a steel roll including a core and an outer part by cold forming;

(ii) subsequently subjecting said roll to an annealing heat treatment by progressively heating the drawn roll up to a specified temperature, (iii) stopping the heat treatment before reaching a temperature at which a reaction between the carbon in the steel and $H_2O$ in a vapor phase begins, thereby avoiding the reaction between the carbon in the steel and the water vapor, (iv) allowing the core of the steel roll to heat progressively until its temperature becomes the same as that in the outer part of the roll, while progressively removing moisture from the core of the steel roll, until reaching a moisture level which generates a sufficiently low partial pressure to avoid reaction between the carbon in the steel and the water vapor;

(v) continuing heating of the roll up to a desired annealing temperature, thus obtaining rolls which are not decarburized; and (vi) allowing the entire roll to cool slowly to ambient temperature.

2. The process according to claim 1, comprising stopping the heat treatment of the drawn roll at a temperature between 620° C. and 670° C.

3. The process according to claim 1, wherein the desired annealing temperature is 680° C. or higher.

4. The process according to claim 1, further comprising the step of (i) continually analyzing the moisture content in the form of water vapor present in an atmosphere in direct contact with the rolls of drawn steel during said annealing heat treatment, (ii) if the $H_2O$ level is sufficiently low, continuing the heating up to the specified annealing temperature and reducing an incoming flow of atmosphere into the annealing surface, and (iii) if the level of $H_2O$ is higher than a value which is considered to be without risk of reaction with the carbon in the steel, increasing the incoming flow of atmosphere during the annealing heat treatment.

5. A process for annealing carbon steel sheet coils comprising the steps of:

(i) passing steel which has to be shaped, to which a lubricant has previously been applied, through a rolling mill in order to obtain a specific cross-section, yielding a coil of steel sheet, including a core and an outer part, through cold forming;

(ii) subjecting said coil of steel sheet to an annealing heat treatment by progressively heating the coil of rolled sheet steel up to a specific temperature, (iii) stopping the heating of the sheet steel coil before reaching a temperature at which a reaction between carbon in the steel and $H_2O$ in the vapor phase begins, avoiding the reaction between the carbon in the steel and the water vapor, (iv) allowing the core of the steel coil to heat up progressively until its temperature becomes the same as that in the outer part of the steel coil, with the progressive removal of moisture from the core of the steel coil, until a moisture level is reached having a sufficiently low partial pressure to avoid a reaction between the carbon in the steel and the water vapor, (v) continuing the heating up to the desired annealing temperature, (vi) cooling the entire coil of steel sheet, thus obtaining coils of steel which are not decarburized.

6. The process according to claim 1, wherein the only annealing gas introduced during the annealing heat treatment is nitrogen.

7. The process according to claim 5, wherein the only annealing gas introduced during the annealing heat treatment is nitrogen.

8. The process according to claim 1, further comprising the step of analyzing the moisture content in the form of water vapor present in an atmosphere in direct contact with the rolls of drawn steel during said annealing heat treatment.

9. The process according to claim 5, further comprising the step of analyzing the moisture content in the form of water vapor present in an atmosphere in direct contact with the carbon steel sheet coils during said annealing heat treatment.

10. The process according to claim 5, further comprising the step of (i) continually analyzing the moisture content in the form of water vapor present in an atmosphere in direct contact with the carbon steel sheet coil during said annealing heat treatment, (ii) if the $H_2O$ level is sufficiently low, continuing the heating up to the specified annealing temperature and reducing an incoming flow of atmosphere into the annealing surface, and (iii) if the level of $H_2O$ is higher than a value which is considered to be without risk of reaction with the carbon in the steel, increasing the incoming flow of atmosphere during the annealing heat treatment.

* * * * *